US007367272B2

(12) United States Patent
Taylor

(10) Patent No.: US 7,367,272 B2
(45) Date of Patent: May 6, 2008

(54) DOOR POSITION INDICATING MECHANISM FOR A RAILCAR

(76) Inventor: Fred J. Taylor, 6485 Rogers La., Burlington, KY (US) 41005

( * ) Notice: Subject to any disclaimer, the term of this patent is extended or adjusted under 35 U.S.C. 154(b) by 416 days.

(21) Appl. No.: 11/215,703

(22) Filed: Aug. 30, 2005

(65) Prior Publication Data

US 2006/0042500 A1 Mar. 2, 2006

Related U.S. Application Data

(60) Provisional application No. 60/605,814, filed on Aug. 31, 2004.

(51) Int. Cl.
*B61D 3/00* (2006.01)

(52) U.S. Cl. ..... 105/286; 105/240; 105/280

(58) Field of Classification Search ..... 105/240, 105/247, 250, 251, 280, 282.1, 282.2, 282.3, 105/283, 284, 286, 296, 297, 298, 299
See application file for complete search history.

(56) References Cited

U.S. PATENT DOCUMENTS

| | | | | | |
|---|---|---|---|---|---|
| 1,022,521 | A * | 4/1912 | Weaver | 105/297 |
| 3,360,302 | A * | 12/1967 | Bagguley | 105/247 |
| 3,580,642 | A * | 5/1971 | Nagy | 406/128 |
| 5,249,531 | A * | 10/1993 | Taylor | 105/286 |
| 5,823,118 | A * | 10/1998 | Manstrom | 105/240 |
| 6,263,803 | B1 * | 7/2001 | Dohr et al. | 105/282.3 |
| 6,412,422 | B2 * | 7/2002 | Dohr et al. | 105/282.3 |
| 7,140,303 | B2 * | 11/2006 | Fortuna | 105/282.1 |

* cited by examiner

*Primary Examiner*—Lars A. Olson
(74) *Attorney, Agent, or Firm*—Jerrold J. Litzinger

(57) ABSTRACT

A door position indicating mechanism for use with a railroad car. The mechanism includes a shaft which extends across the longitudinal direction of the car. An offset section of the shaft has a roller which contacts a lever which is shifted by an air cylinder when operating the door mechanism. At least one counterweight biases the roller into constant contact with the door operating lever. Indicators are mounted on either end of the shaft such that the position of the doors can be noted from either side of the railroad car.

20 Claims, 8 Drawing Sheets

DOOR POSITION INDICATING MECHANISM FOR A RAILCAR

CROSS-REFERENCE TO RELATED APPLICATIONS

This application claims benefit from U.S. Provisional Patent Application Ser. No. 60/605,814 filed Aug. 31, 2004, which application is incorporated herein by reference.

BACKGROUND OF THE INVENTION

1. Field of the Invention

This invention relates generally to railcars and, in particular, to an indicating mechanism for monitoring the hopper doors of a railcar.

2. Description of the Related Art

A common type of railroad freight car in use today is the freight car of the type wherein the load is discharged through hoppers in the underside of the body. Such cars are generally referred to as hopper cars and are used to haul coal, phosphate and other commodities.

After hopper cars are spotted over an unloading pit, the doors of the hoppers are opened, allowing the material within the hopper to be emptied into the pit.

Hopper cars, which may be covered, are usually found with one of two hopper configurations: transverse, in which the doors closing the hoppers are oriented perpendicular to the center line of the car; or longitudinal, in which the doors closing the hoppers are oriented parallel to the center line of the car. An example of a hopper car with transverse doors is shown in U.S. Pat. No. 5,249,531, while an example of a hopper car with longitudinal doors is shown in U.S. Pat. No. 4,224,877.

Prior art references which teach operating mechanisms for opening and closing hopper doors include U.S. Pat. Nos. 3,596,609; 4,741,274; 3,187,684; 3,611,947; 3,786,764; 3,815,514; 3,818,842; 3,949,681; 4,222,334; 4,366,757; 4,601,244; 5,823,118; and 5,249,531. There are several disadvantages to the hopper door operating mechanisms described in some of the aforementioned patents. One problem is that some of the prior art mechanisms are designed such that each actuating mechanism is connected to doors from two separate hoppers. Thus, if the mechanism fails, it effects the operation of two hoppers. Another disadvantage of some of the above described hopper door mechanisms is that the operating mechanisms limit the distance of the door motion, thus limiting the open area of the car's bottom. This arrangement slows the unloading process and causes additional costs and potential damage to the car due to increased periods in thaw sheds. However, many of these systems usually require automatic operation of the doors, which requires an operating cylinder and valving.

When using automatic door operating systems, it is important to be certain that the doors are fully closed. Many automatic door systems are designed with an overcenter latch to insure that the doors will not inadvertently open, as this could cause serious injury and/or damage to occur.

One problem which may occur with an operating cylinder is a condition in which the air cylinder is leaking, allowing the movable shaft within the cylinder to falsely indicate the actual state of the cylinder (activated or deactivated).

Another potential disadvantage of using an air cylinder operating door system is that the air cylinder is usually physically located where it is difficult to actually observe the movement of the movable shaft actuating the hopper doors.

SUMMARY OF THE INVENTION

It is therefore an object of the present invention to provide a door position indicating mechanism for a railcar which physically monitors the operating lever of system rather than the movable air cylinder shaft.

It is a further object of the present invention to provide a door position indicating mechanism which can be easily seen while standing alongside the railcar.

It is a still further object of the present invention to provide a door indicating mechanism for a railcar which is reliable, accurate and inexpensive.

It is a still further object of the present invention to provide an indicating mechanism which can be installed on new railcar construction, as well as retrofitted onto existing railcars.

These and other objects of the present invention will be more readily apparent from the description and drawings which follow.

DESCRIPTION OF A PREFERRED EMBODIMENT

Figure 1:
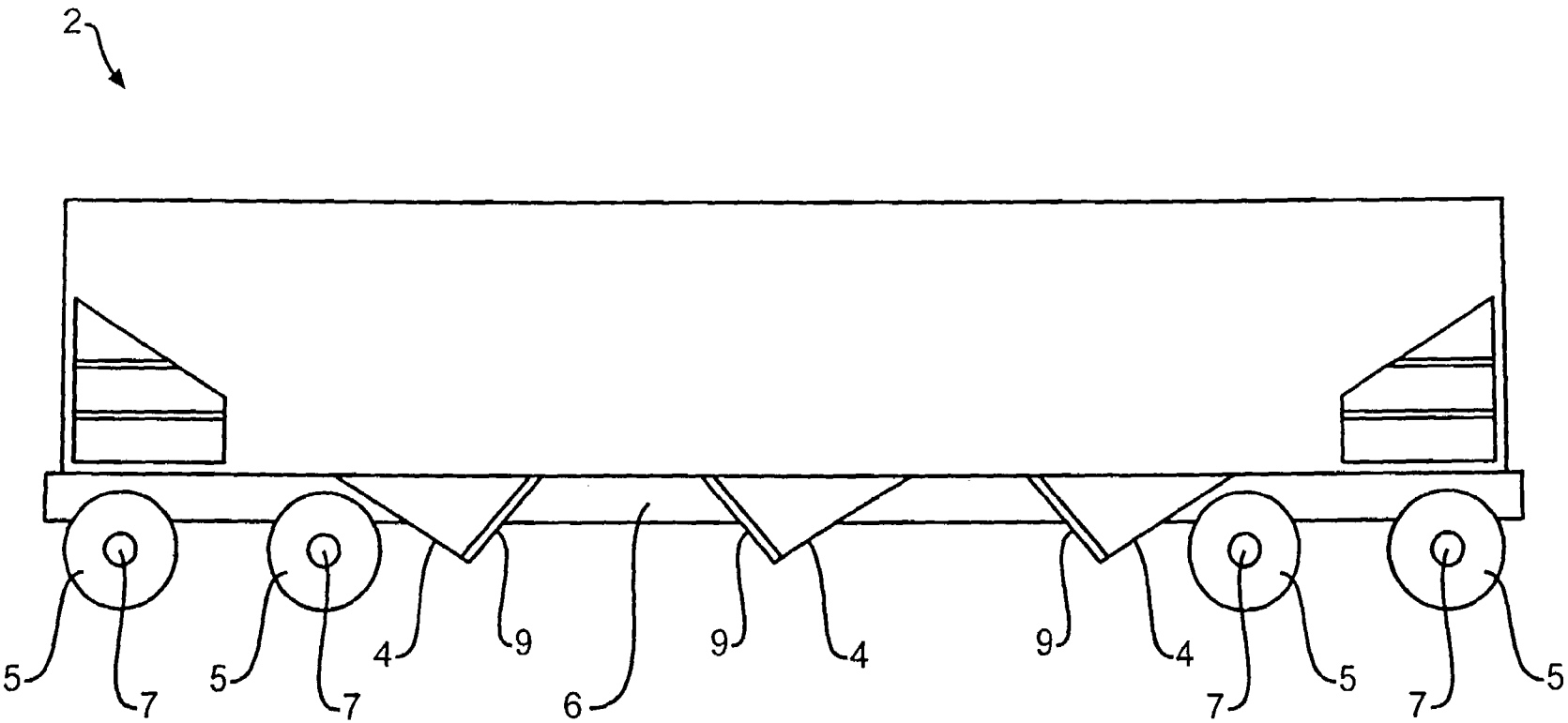
FIG. 1 is an elevational view of a standard three pocket hopper car having a single transverse door associated with each hopper which is capable of using the present invention.
Figure 2:
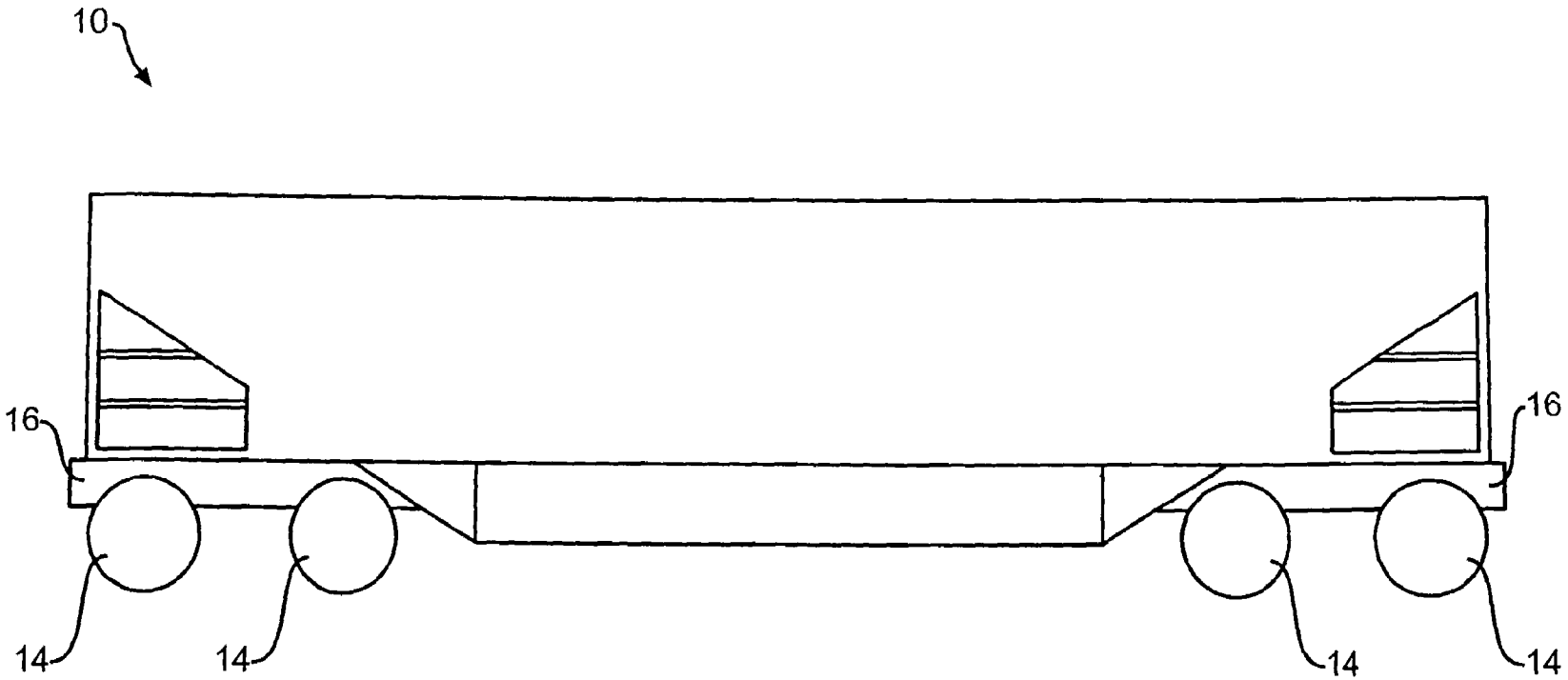
FIG. 2 is an elevational view of a hopper car having a longitudinal door set which is capable of using the present invention.
Figure 3:
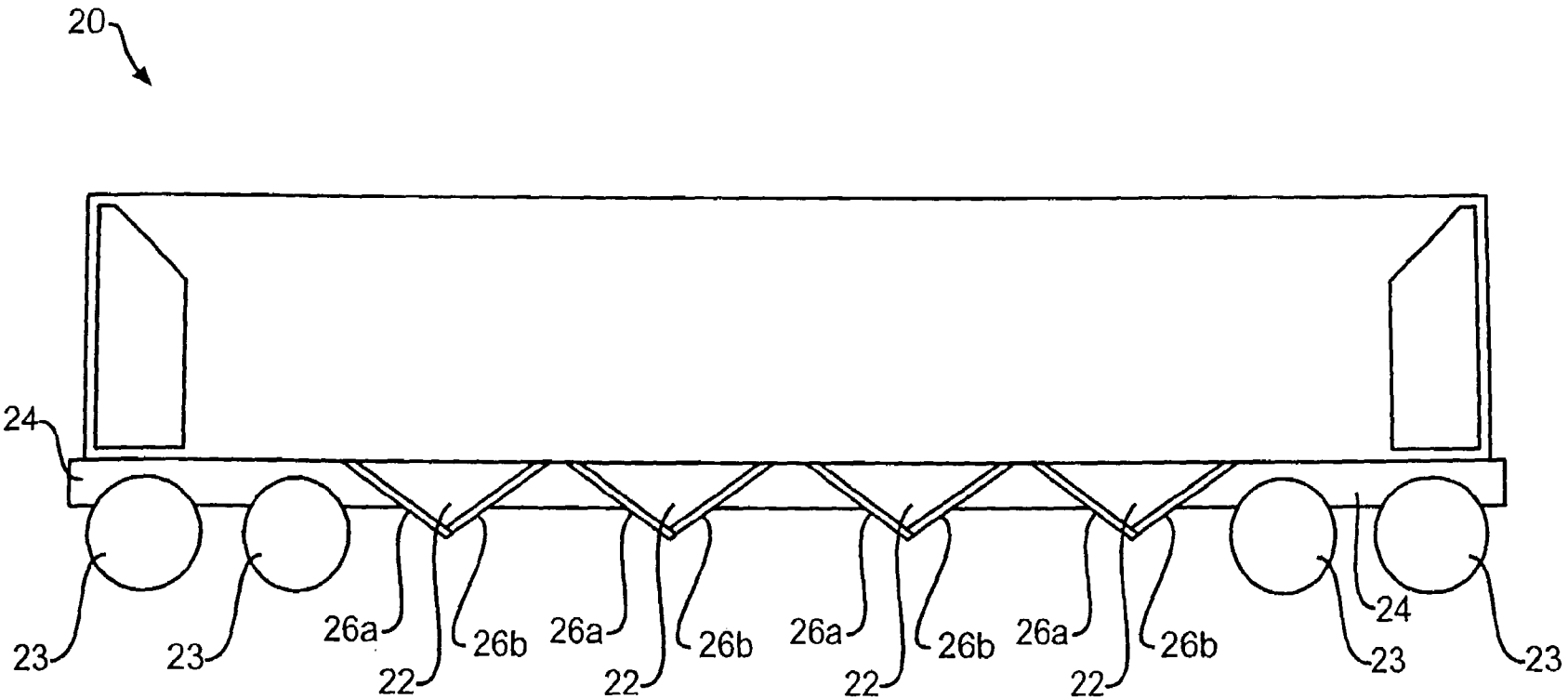
FIG. 3 is an elevational view of a standard four pocket hopper car having transverse doors which is capable of using the present invention.

FIGS. 1-3 display three different major types of hopper cars. FIGS. 1 and 3 show hopper cars using transverse doors, while FIG. 2 shows a car using longitudinal doors.

Referring now to FIG. 1, there is shown a typical three pocket railway hopper car, generally designated at 2, which may be equipped with a preferred embodiment of the present invention. Car 2 is provided with a plurality of hopper units 4, a plurality of wheels 5, and a longitudinally extending center sill 6. Wheels 5 are mounted on a series of truck axles 7. Each hopper unit 4 is provided with a door 9 which is moveable to open and close each hopper unit 4. An actuating system for this type of car is taught in U.S. patent application Ser. No. 10/863,887, filed Jun. 8, 2004, which application is incorporated herein by reference.

Referring now to FIG. 2, there is shown a typical hopper railcar, generally indicated at 10, having longitudinal doors which may be equipped with a preferred embodiment of the present invention. Car 10 is provided with a longitudinal door set 2, a plurality of wheels 14, and a longitudinally extending center sill 16. An operating system for this type of hopper car is taught in U.S. patent application Ser. No. 10/977,008, filed Oct. 29, 2004, which application is incorporated herein by reference. Although the system taught in this application teaches the operation of a single pair of doors, the mechanism can be used to open multiple sets of longitudinal doors.

Referring now to FIG. 3, there is shown a typical four pocket hopper car, generally designated at 20, which may be equipped with a preferred embodiment of the present invention. Car 20 is provided with a plurality of hopper units 22, a plurality of wheels 23, and a longitudinally extending center sill 24. Each of hopper units 22 are covered by a pair of doors 26*a* and 26*b*. The actuating mechanism for this type of car is taught in U.S. Pat. No. 5,249,501, which issued Oct. 5, 2993, which patent is incorporated herein by reference.

The indicating system according to the present invention can be most clearly seen in FIGS. 3-7. Referring now to FIG. 3, a door position indicating mechanism, indicated at 40, is shown assembled in position on a railcar. An air cylinder 42 is mounted on a center sill 44 over the wheels 45 of the railcar via a connection to a rear cylinder mount 46 by a rear cylinder pin 48. Cylinder 42 contains a slidable operating rod 50 having a cylinder rod clevis 52. A main actuating lever 54, which pivots about a pin 56, is coupled between clevis 52 on cylinder 42 and an actuating beam 58 by a pair of pins 60. Actuating beam 58 is connected to the door operating system for the railcar, and operates the doors in the manner described in U.S. Pat. No. 5,249,501, or U.S. patent application Ser. Nos. 10/863,887 and 10/977,008, depending on whether the railcar uses transverse or longitudinal doors.

In the present embodiment, cylinder 42 is preferably mounted on center sill 44 behind end slope sheet 64 of the railcar.

Figure 6:
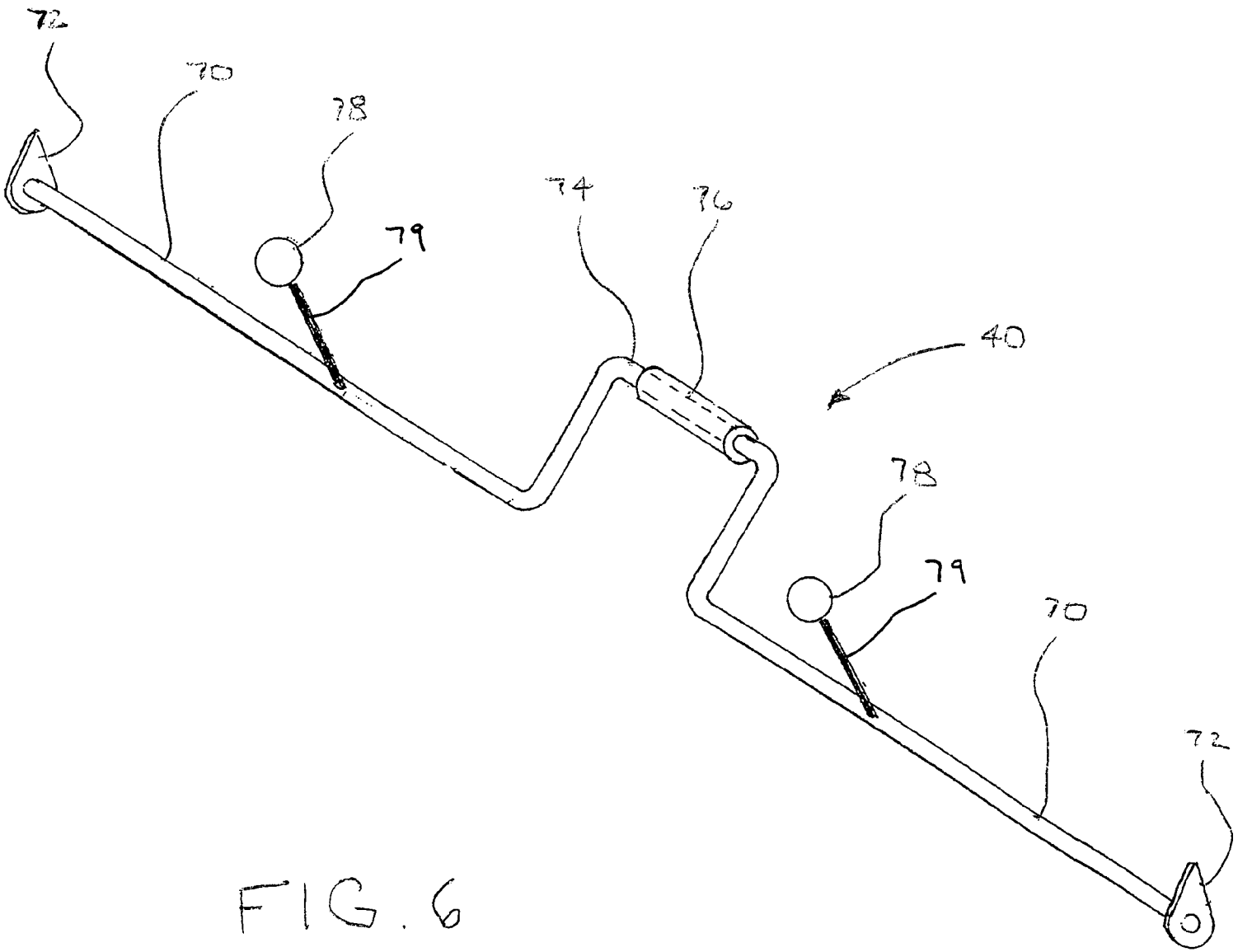
FIG. 6 is a perspective view of the indicating system of the present invention.
Figure 7:
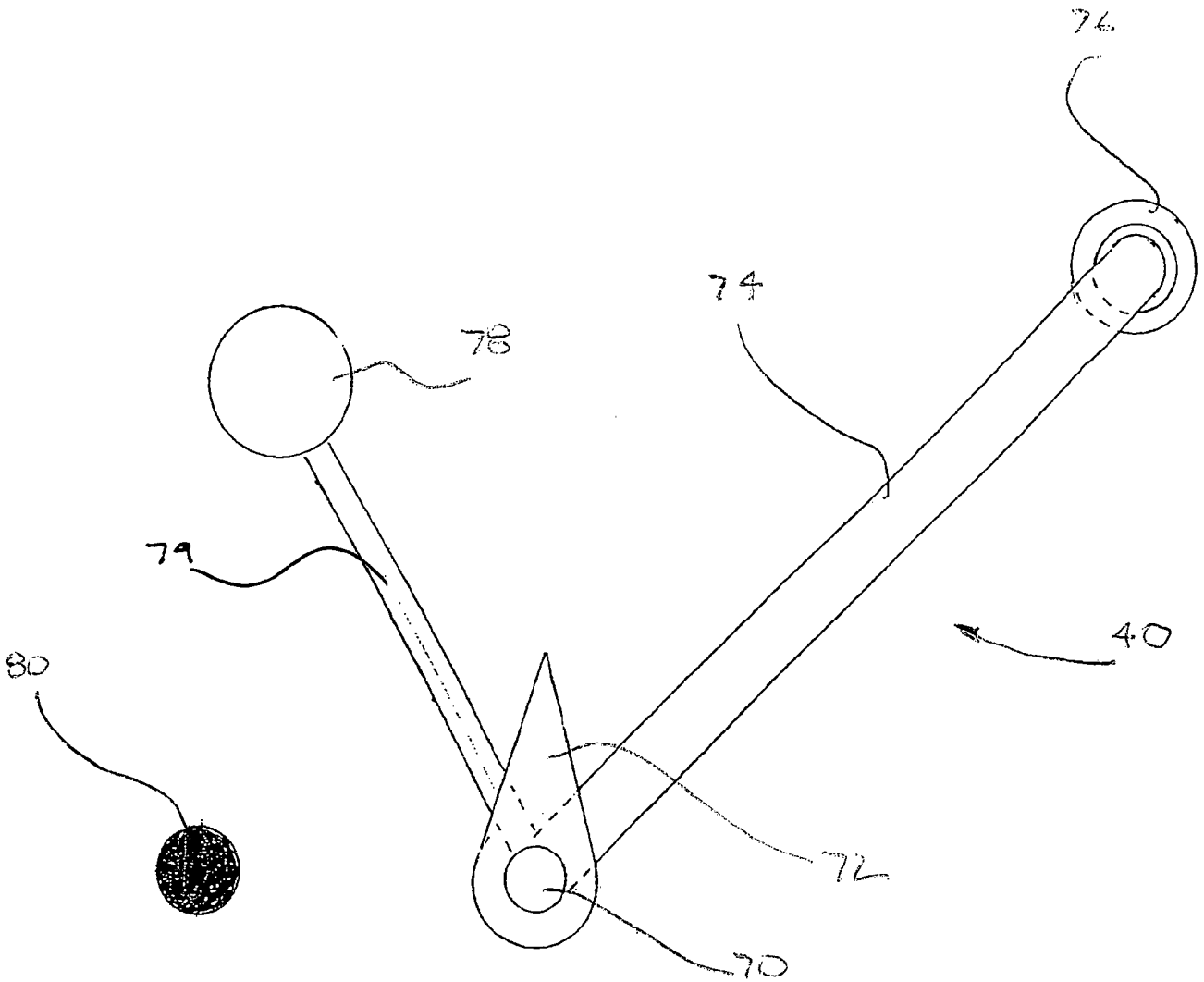
FIG. 7 is an elevational view of the indicating system taught in FIG. 6.

Door indicating mechanism 40 is shown in detail in FIG. 6. Mechanism 40 consists of main shaft 70 having an indicator 72 mounted on each end. Shaft 70 is of sufficient length such that indicators 72 are mounted on the outside of each body side sheet 73. The central section 74 is offset from shaft 70 and contains a roller 76 mounted for rotation on section 74. Extending outwardly from shaft 70 spaced on either side of section 74 are a pair of counterbalances or counterweights 78 which are connected to shaft 70 by arms 79. Counterweights 78 are used to bias roller 76 such that roller 76 is always positioned in contact with main actuating lever 54. The travel of counterweights 78 is limited by a stop lug 80 (FIG. 7). Counterweights 78 contain enough weight such that roller 76 always stays in constant contact with lever 54. Preferably, the total weight contained within counterweights 78 is at least approximately 2 pounds.

Figure 8:
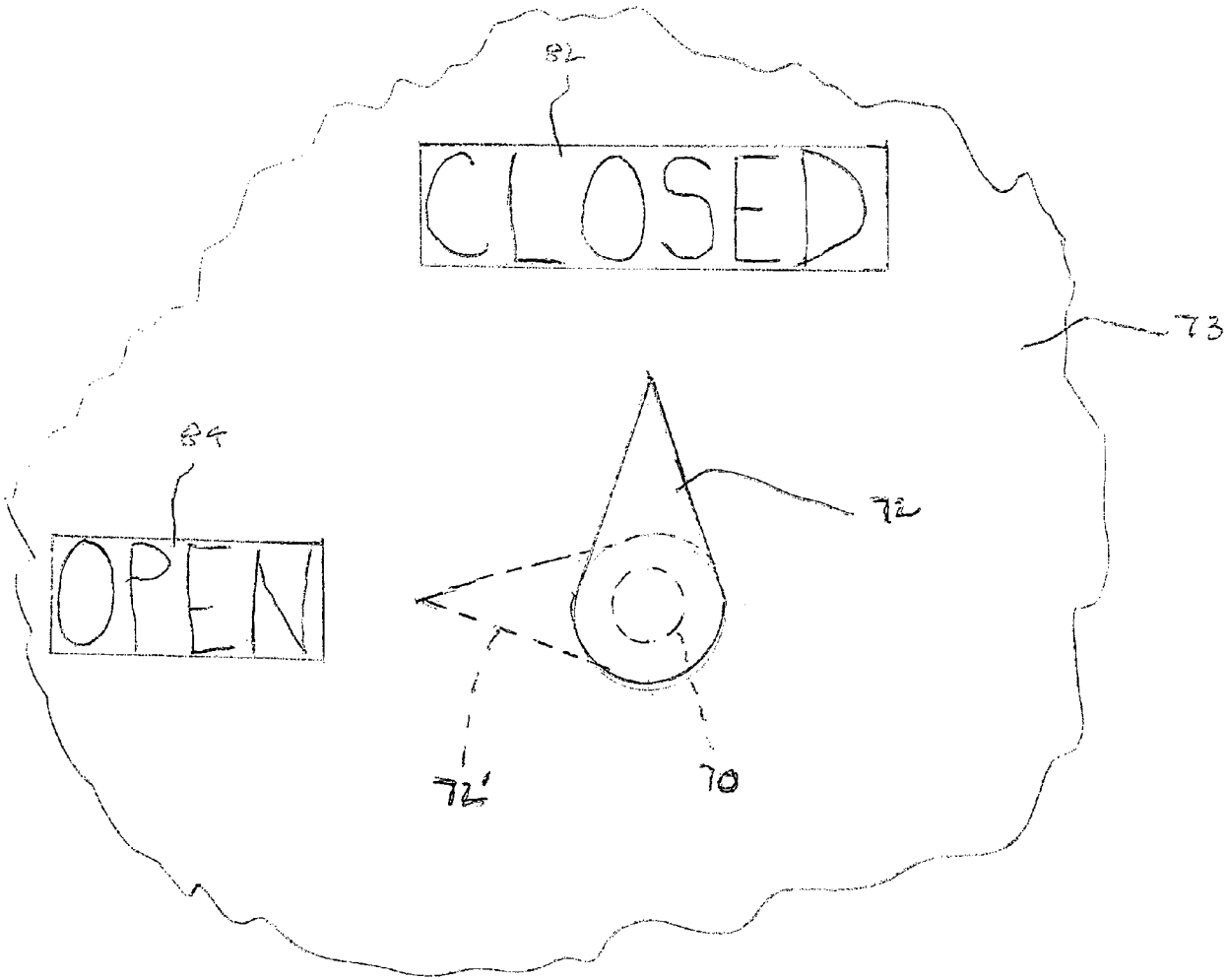
FIG. 8 is a partial elevational view of the indicating system of the present invention.

The operation of door position indicating system 40 will now be described. When the hopper doors are closed, air cylinder 41 is in the position shown in FIG. 4, with shaft 50 located primarily within cylinder 42. Roller 76 is positioned in constant contact with actuating lever 54, by virtue of counterweights 78 biasing shaft 70 in a counterclockwise direction. In this position, indicator 72 points to the "closed" indicia 82 as seen in FIG. 8. When the door operating system is activated, shaft 50 of air cylinder shafts to the left in FIG. 4, causing main actuating lever 54 to pivot about pin 56 in a counterclockwise direction, causing actuating beam 58 to shift to the right. As roller 76 is biased by counterweight 78 to remain in contact with shaft 54, shaft 70 turns, moving indicator 72 to the position shown in FIG. 8 at 72', pointing to the "open" indicia 84. Indicia 82, 84 are preferably written with a light reflective material. In addition, indicia 82, 84 may be written using a luminescent, phosphorescent, photoluminescent, fluorescent or chemiluminescent material.

Figure 4:
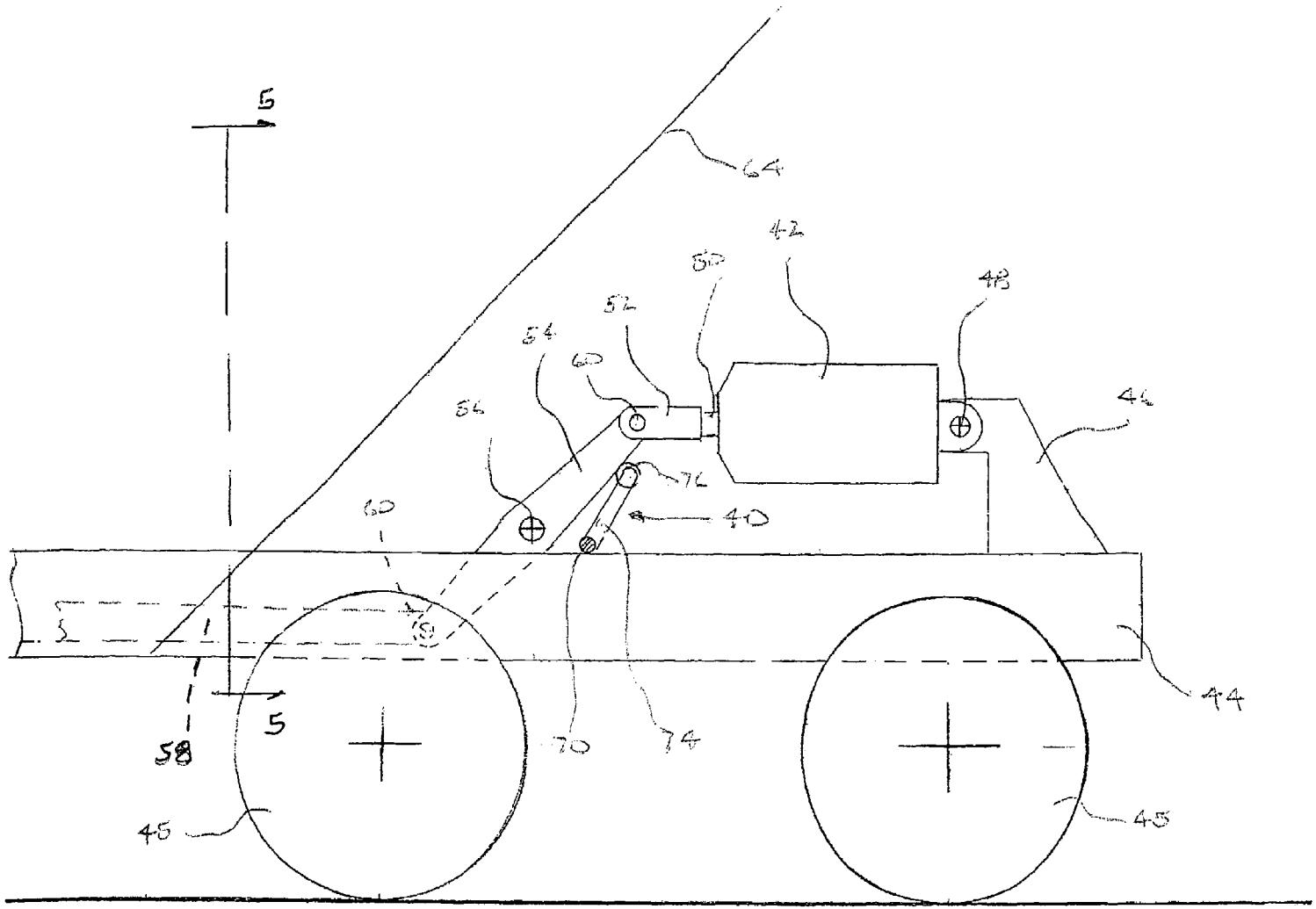
FIG. 4 is an elevational view of an indicating system according to the present invention installed on a railcar using an air cylinder to activate the door opening mechanism.
Figure 5:
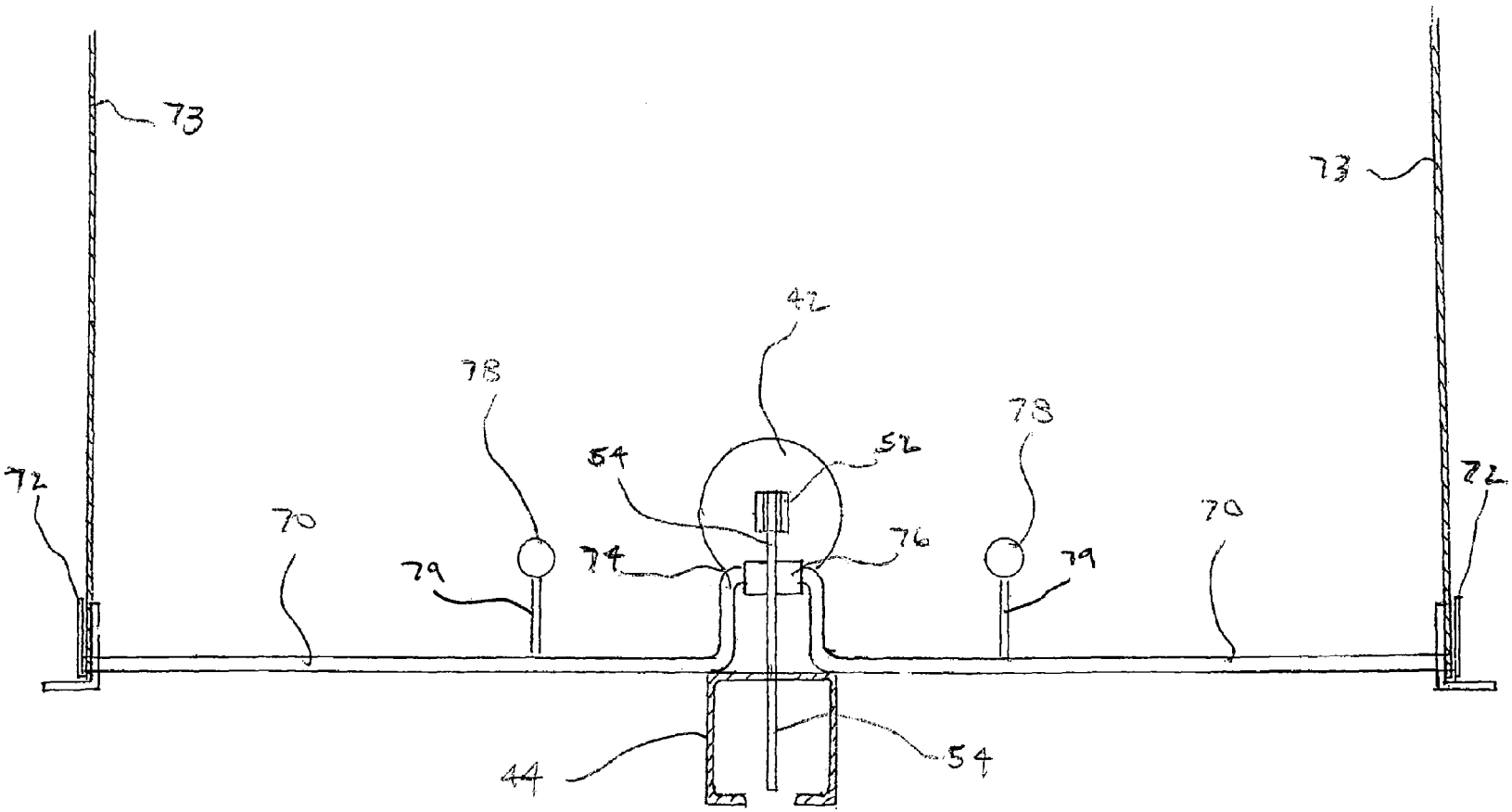
FIG. 5 is a sectional view taken along line 5-5 of FIG. 4.

To close the hopper doors, operation of air cylinder 42 is reversed, causing shaft 50 to retract, pivoting lever 54 in a clockwise direction and consequently shifting actuating beam 58 back to the left in FIG. 4. Roller 76 of system 40 stays in contact with lever 54, causing indicator 72 to return to its initial position pointing to the "closed" indicia 82 (FIG. 8).

As system 40 operates by monitoring the actual movement of lever 54, which is directly coupled to the door operating system by beam 58, it will always indicate the true position of the hopper doors. In addition, as an indicator 72 is located on either side of the railcar, the position of the hopper doors can be discerned easily from either side, without climbing under the car or having to look to the top of the car for an indicator.

In the above description, and in the claims which follow, the use of such words as "left", "right", "clockwise", "counterclockwise", "distal", "proximal", "forward", "outward", "rearward", "vertical", "horizontal", and the like is in conjunction with the drawings for purposes of clarity.

While the invention has been shown and described in terms of a preferred embodiment, it will be understood that this invention is not limited to this particular embodiment, and that many changes and modifications may be made without departing from the true spirit and scope of the invention as defined in the appended claims.

What is claimed is:

1. A door position indicating mechanism for a railroad car, having a door operating system for opening and closing hopper doors of the car, comprising:

a rotatable shaft, extending through each side of the railroad car, said shaft containing an offset section having a roller mounted thereon;

at least one counterweight, affixed to said shaft, for maintaining said roller in constant contact with an operating lever connected to the door operating system of the car;

and at least one means for indicating the position of the hopper doors of the railroad car.

2. The mechanism of claim 1, wherein said indicating means comprises an arrow.

3. The mechanism of claim 1, further including a pair of counterweights located on either side of said offset section of said shaft.

4. The mechanism of claim 1, further including a pair of arrows attached to each end of said shaft.

5. The mechanism of claim 1, wherein the total weight of said counterweight is approximately 2 pounds.

6. The mechanism of claim 1, further comprising a stop lug for limiting the travel of said counterweight.

7. The mechanism of claim 1, further comprising a pair of arrows, with one arrow mounted on each end of said shaft on the outside of each side of the railroad car.

8. A door position indicating mechanism for use with railroad hopper car having at least one hopper which is opened and closed by a hopper door which is operated by a door operating system with an actuating beam coupled to an air cylinder by an operating lever, said mechanism comprising:

a rotatable shaft, extending through each side of the car;

a roller, rotatably mounted on said shaft;

at least one counterweight, affixed to said shaft, for maintaining said roller in constant contact with the operating lever of said door operating system;

and at least one means for indicating the position of the at least one hopper door;

wherein when said at least one hopper door is shifted from the closed to the open position, said roller is held against the operating lever by said counterweight, rotating said shaft and moving said indicating means to indicate that said at least one door is in the open position.

9. The mechanism of claim 8 further comprising a plurality of counterweights, with at least one counterweight located on either side of said roller.

10. The mechanism of claim 8, wherein said shaft contains an offset section where said roller is located.

11. The mechanism of claim 8, wherein said counterweight weighs approximately 2 pounds.

12. A railroad car, comprising:

a pair of opposing side walls along with a pair of opposing end walls;

at least one hopper having at least one hopper door shiftable between an open position and a closed position;

a door operating system for shifting said at least one door between its open and closed position;

an air cylinder;

an actuating beam coupled to said door operating system;

an operating lever coupling said air cylinder to said actuating beam;

and a door position indicating mechanism, said mechanism comprising:

a rotatable shaft, extending across said railroad car in a longitudinal direction to the outer side of at least one side wall, having an offset section containing a roller;

at least one counterweight, affixed to said shaft, for maintaining said roller in constant contact with said operating lever;

and at least one means, coupled to the end of said shaft, for indicating the position of said at least one hopper door of said railroad car.

13. The car of claim 12, further comprising a first indicia located on the outer side of at least one side wall indicating that said at least one hopper door is open, and a second indicia located on said outer side indicating that said at least one hopper door is closed.

14. The car of claim 13, wherein said indicating means comprises an arrow pointing to said first indicia or said second indicia.

15. The car of claim 13, wherein said first and second indicia are composed of a light reflective material.

16. The car of claim 13, wherein said first and second indicia are composed of a phosphorescent material.

17. The car of claim 12, further including a pair of counterweights located on either side of said offset section of said shaft.

18. The car of claim 12, wherein the total weight of said counterweight comprises approximately 2 pounds.

19. The car of claim 12, further comprising a stop lug for limiting the travel of said counterweight.

20. The car of claim 13, wherein said first indicia reads OPEN and said second indicia reads CLOSED.

* * * * *